US011776431B2

(12) United States Patent
Kebel et al.

(10) Patent No.: US 11,776,431 B2
(45) Date of Patent: Oct. 3, 2023

(54) MULTILAYER LABEL

(71) Applicant: Stryker European Operations Limited, Carrigtwohill (IE)

(72) Inventors: Roland Kebel, Wangen an der Aare (CH); Tilman Ernst, Grenchen (CH)

(73) Assignee: Stryker European Operations Limited

( * ) Notice: Subject to any disclaimer, the term of this patent is extended or adjusted under 35 U.S.C. 154(b) by 0 days.

(21) Appl. No.: 17/573,800

(22) Filed: Jan. 12, 2022

(65) Prior Publication Data

US 2022/0230564 A1 Jul. 21, 2022

Related U.S. Application Data

(60) Provisional application No. 63/138,012, filed on Jan. 15, 2021.

(51) Int. Cl.
*G09F 3/02* (2006.01)
*G09F 3/00* (2006.01)

(52) U.S. Cl.
CPC .... *G09F 3/0289* (2013.01); *G09F 2003/0213* (2013.01); *G09F 2003/0258* (2013.01); *G09F 2003/0269* (2013.01); *G09F 2003/0272* (2013.01)

(58) Field of Classification Search
CPC ..... G09F 3/0289; G09F 2003/0213; G09F 2003/0258; G09F 2003/0269; G09F 2003/0272; G09F 3/10; G09F 2003/021
See application file for complete search history.

(56) References Cited

U.S. PATENT DOCUMENTS 5,340,158 A * 8/1994 Bartl ..... G09F 3/0289 283/105
5,730,469 A * 3/1998 Heimerdinger ..... G09F 3/02 283/79
6,089,613 A 7/2000 Petkovsek
7,815,123 B2 10/2010 Conner et al.
(Continued)

FOREIGN PATENT DOCUMENTS

CA 2 841 636 A1 7/2015
EP 4030410 A1 * 7/2022 ..... G09F 3/0289
IT 20163778 A1 11/2017

OTHER PUBLICATIONS

Extended European Search Report issued in Appln. No. 22151312.0 dated Jun. 10, 2022 (2 pages).

*Primary Examiner* — Cassandra Davis
(74) *Attorney, Agent, or Firm* — Lerner David LLP

(57) ABSTRACT

A label for a package that includes a base layer and a top layer attached to the base layer is disclosed. The base layer includes a central surface adapted to receive written markings. The top layer covers at least part of the base layer and includes perforations such that a detachable part of the top layer has a perimeter at least partially defined by the perforations. The detachable part includes a front surface and a back surface that faces the base layer while the perforations remain intact. The front and back surfaces of the top layer are adapted to receive written markings. And, the top layer is opaque such that while the perforations remain intact, any written markings on the back surface of the detachable part or on the central surface of the base layer are not visible from a vantage point outside of the label.

18 Claims, 5 Drawing Sheets

(56) References Cited

U.S. PATENT DOCUMENTS

| | | | | |
|---|---|---|---|---|
| 9,707,039 | B2 | 7/2017 | Grabowski et al. | |
| 2011/0232234 | A1 | 9/2011 | Lockwood et al. | |
| 2019/0135484 | A1* | 5/2019 | Huffer ..... | B65D 77/2032 |

* cited by examiner

MULTILAYER LABEL

CROSS-REFERENCE TO RELATED APPLICATION

This application claims the benefit of the filing date of U.S. Provisional Patent Application No. 63/138,012, filed Jan. 15, 2021, the disclosure of which is hereby incorporated by reference herein in its entirety.

BACKGROUND OF THE INVENTION

When a package is shipped and delivered to a recipient, a label is typically included to communicate information about the product and the contents of the package, i.e. product identification. In many instances, such as is the case with medical devices, there may be a need to communicate a significant amount of information, including potentially sensitive information that should only be viewed by the recipient and other interested parties.

Current approaches to labeling often simply involve adding more labels or increasing the size of labels to convey additional information to a recipient. However, such efforts may be burdensome in terms of time, effort and cost. Additionally, with existing approaches in the medical device field, for example, information to be received separately by a recipient, such as a leaflet, is typically provided in a separate label included inside the packaging itself. In such cases, the separate label cannot be accessed immediately and must instead be removed from the package before the recipient can use it.

Thus, a need exists for improvements in the efficiency of labels for packages and in the way information is conveyed through such labels.

BRIEF SUMMARY OF THE INVENTION

Labels contemplated by the present disclosure provide usable surfaces for label text and imagery that are much greater in area than a portion of the label that is adhered to a package. In some examples, the usable surfaces are three times that of the portion of the label adhered to the package, or put another way, 200% more than the portion of the label adhered to the package.

In one aspect, the present disclosure relates to a label that may be attached to a package. In a first embodiment, the label includes a base layer and a top layer attached to the base layer, the top layer including a detachable part secured to the remainder of the top layer via perforations. This detachable part may be fully removed from the rest of the label to be provided as an information card for the recipient of the package accompanying the label. Because the information card is detachable form the label itself, it may convey important information to the recipient of the package without the need to open the package.

In a first example of a second embodiment, a label attachable to a package includes a base layer and a top layer attached to the base layer such that the top layer covers the first surface. The base layer includes a first surface adapted to receive written markings. The top layer includes perforations that extend from two separate locations at a first end of the top layer and form a closed loop within the top layer. The top layer also includes a flap that extends from the first end in between the two separate locations at the first end. A first portion of the top layer enclosed by the perforations and including the flap defines a detachable part. The detachable part is removable from a second portion of the top layer by pulling the flap away from the first end toward a second end of the top layer opposite the first end, the detachable part being fully removable from the second portion. The detachable part has a front surface and a back surface opposite the front surface, both surfaces being adapted to receive written markings.

In a second example of the second embodiment, the detachable part may have a first surface area and the top layer may have a second surface area, the first surface area being at least 50% of the second surface area. In a third example of the second embodiment, the label of the first or second example may be part of a system that also includes a package. In this system, the label may have a surface area in contact with the package that is equal to the second surface area. In a fourth example of the second embodiment, written markings of any one of the first through third examples may include at least one of printed text and printed imagery created through a thermal transfer process.

In a first example of a third embodiment, a label includes a base layer and a top layer attached to the base layer such that the top layer covers at least part of the base layer. The base layer includes a central surface adapted to receive written markings. The top layer includes perforations such that a detachable part of the top layer has a perimeter at least partially defined by the perforations. The detachable part includes a front surface and a back surface opposite the front surface. The back surface faces the central surface while the perforations remain intact. The front surface and the back surface are adapted to receive written markings. And, the top layer is opaque such that while the perforations remain intact, any written markings on the back surface of the detachable part or on the central surface of the base layer are not visible from a vantage point outside of the label.

In a second example of the third embodiment, the written markings may include at least one of printed text and printed imagery created through a thermal transfer process.

In a first example of a fourth embodiment, a label that is attachable to a package includes a base layer and a top layer. The base layer includes a first surface adapted to receive written markings and a second surface opposite the first surface, the second surface positionable onto a package. The top layer is attached to the base layer such that the top layer covers the first surface. The top layer includes a peripheral part and a detachable part that is located within the peripheral part. The detachable part has a front surface and a back surface opposite the front surface, both surfaces being adapted to receive written markings. A first portion of a perimeter of the detachable part has perforations that separate the detachable part from the peripheral part. A second portion of the detachable part forms a free end of the detachable part. The detachable part is removable from the peripheral part of the top layer by pulling the free end away from a first end of the top layer toward a second end of the top layer opposite the first end. The detachable part may be fully removed from the peripheral part.

In a second example of the fourth embodiment, the label of the first example is arranged such that the detachable part may have a first surface area and the top layer may have a second surface area, the first surface area being at least 50% of the second surface area. In a third example of the fourth embodiment, the label of the first or second example may be part of a system including a package and the label. The label may have a surface area in contact with the package that is equal to the second surface area. In a fourth example of the fourth embodiment, the label of any one of the first through third examples may have a detachable part such that the perimeter of the detachable part forms a closed loop within the peripheral part, the detachable part having a tab at the free end unconnected to the peripheral part. In a fifth example of the fourth embodiment, the perforations of the fourth example may extend along a first side of the detachable part from the free end to a second end of the detachable part opposite the free end and along a second side of the outer edge opposite the first side from the free end to the second end. In a sixth example of the fourth embodiment, the detachable part of the fifth example may include a trailing side at the second end, the trailing side extending between the first side and the second side and being unconnected to the peripheral part. In a seventh example of the fourth embodiment, any one of the first through sixth examples may have a detachable part such that the back surface of the detachable part has a first surface area and the label has a total surface area adapted to receive written markings that is at least three times the first surface area. In an eighth example of the fourth embodiment, any one of the first through seventh examples have written markings that may include at least one of printed text and printed imagery created through a thermal transfer process.

In a first example of a fifth embodiment, a label for a package includes a base layer and a top layer. The base layer is adherable onto a package and includes a central surface adapted to receive written markings. The top layer is attached to the base layer such that the top layer covers at least part of the base layer. The top layer includes perforations such that a detachable part of the top layer has a perimeter at least partially defined by the perforations. The detachable part includes a front surface and a back surface opposite the front surface such that the back surface faces the central surface while the perforations remain intact. Both the front and back surfaces of the top layer are adapted to receive written markings. And, the top layer is opaque such that while the perforations remain intact, any written markings on the back surface of the detachable part or on the central surface of the base layer are not visible from a vantage point outside of the label.

In a second example of the fifth embodiment, a majority of the perimeter of the detachable part of the first example may be surrounded by a stationary part of the top layer. In a third example of the fifth embodiment, the label of the second example may have a detachable part that includes a tab at a first end such that the perforations extend from a first location on the perimeter adjacent to the tab to a second location on the perimeter remote from the tab. In a fourth example of the fifth embodiment, the label of the first example may have perforations that include a first segment across a width of the top layer and a second segment across the width of the top layer, the first segment being separate from the second segment such that the top layer includes first and second stationary parts on opposite sides of the detachable part. In a fifth example of the fifth embodiment, the label of the fourth example may have a detachable part that includes a tab, the tab being located such that the first segment of the perforations extends from a first side of the tab to a first outer edge of the top layer and a second segment of the perforations extends from a second side of the tab to a second outer edge of the top layer. In a sixth example of the fifth embodiment, the label of any one of the first through fifth examples may have written markings that include at least one of printed text and printed imagery created through a thermal transfer process.

In a seventh example of the fifth embodiment, at least part of the perimeter of the detachable part of the first example abuts a peripheral part of the top layer, the peripheral part remaining attached when the detachable part is removed. In an eighth example of the fifth embodiment, the detachable part of the first or second example may include a tab at a first end and the perforations extend from a first location on the perimeter adjacent to the tab along a loop around the perimeter to a second location on the perimeter adjacent to the tab, the first location and the second location being on opposite sides of the tab. In a ninth example of the fifth embodiment, the detachable part of the first or second example may extend from a first end to a second end, the perforations being located in between the first and second ends. In a tenth example of the fifth embodiment, the detachable part of the ninth example may include a tab at the first end, the tab being graspable to pull the detachable part from a remainder of the label. In an eleventh example of the fifth embodiment, the label of the ninth or tenth examples may be arranged such that a segment of the detachable part across a width of the detachable part at the second end is absent perforations and is not connected to another part of the label.

In a twelfth example of the fifth embodiment, the label of the first example may include perforations that extend along a first segment across a width of the top layer and along a second segment across the width of the top layer, the first segment being separate from the second segment such that the top layer includes first and second peripheral parts on opposite sides of the detachable part, the peripheral parts remaining attached to the base layer when the detachable part is removed from the base layer. In a thirteenth example of the fifth embodiment, the detachable part of the twelfth example includes a tab along an edge of the detachable part in between the first and second segments or along a length of one of the first and second segments. In a fourteenth example of the fifth embodiment, the label of any one of the seventh through thirteenth examples may be arranged so that the front surface of the detachable part has a first surface area that is at least 50% of a total surface area of an overall front surface of the top layer. In a fifteenth example of the fifth embodiment, the label of any one of the seventh through fourteenth examples may be arranged so that the back surface of the detachable part has a back surface area and the label has a total usable surface area adapted to receive written markings that is at least three times the back surface area. In a sixteenth example of the fifth embodiment, the fifteenth example of the label may be arranged so that the total usable surface area includes the back surface of the detachable part, the front surface of the detachable part, and the central surface of the base layer. In a seventeenth example of the fifth embodiment, the eighth example may have a detachable part that is removable from the peripheral part of the top layer such that the peripheral part remains attached to the base layer after removal, the peripheral part surrounding at least part of the detachable part. In an eighteenth example of the fifth embodiment, any one of the first through seventeenth examples may have written markings that include at least one of printed text and printed imagery created through a thermal transfer process. In a nineteenth example of the fifth embodiment, any one of the first through eighteenth examples of the label may be part of a system that includes a package and the label.

In a first example of a sixth embodiment, a label attachable to a package includes a base layer and a top layer. The base layer includes a front surface adapted to receive written markings thereon. The top layer is attached to the base layer and includes a detachable portion, a peripheral portion and an interface structure between the detachable portion and the peripheral portion. The detachable portion includes a front surface and a back surface, the back surface facing the front surface of the base layer and adapted to receive written markings thereon. The top layer is configured such that pulling of the detachable portion relative to the peripheral portion causes the interface structure to tear, separating the top layer from the base layer such that the interface structure is permanently severed.

In a second example of the sixth embodiment, the interface structure of the label of the first example may be a plurality of perforations. In a third example of the sixth embodiment, the label of the first or second examples may include a top layer made of a material such that any written markings on the back surface of the top layer are not observable from a vantage point outside of the label when the interface structure is intact. In a fourth example of the sixth embodiment, any one of the first through third examples of the label may be arranged such that the detachable portion has a perimeter and a majority of the perimeter is surrounded by the peripheral portion. In a fifth example of the sixth embodiment, at least some of the perimeter of the detachable portion of the fourth example is not defined by the interface structure. In a sixth example of the sixth embodiment, the peripheral portion of any one of the first through third examples of the label may include a first subpart and a second subpart spaced apart from the first subpart. In this example, the detachable portion is in between the first subpart and the second subpart.

In one aspect, the present disclosure relates to a method of identifying whether a label has been tampered with. The method involves: providing a label including a base layer and a top layer attached to the base layer such that the top layer covers the base layer, the top layer including perforations such that a detachable part of the top layer has a perimeter at least partially defined by the perforations; and visually inspecting the label to identify any breaks in the perforations, wherein breaks in the perforations are evaluated to determine whether a back surface of the detachable part or a surface of the base layer facing the detachable part are visible due to the breakage.

BRIEF DESCRIPTION OF THE DRAWINGS

A more complete appreciation of the subject matter of the present disclosure and of the various advantages thereof can be realized by reference to the following detailed description in which reference is made to the accompanying drawings in which.

DETAILED DESCRIPTION

In one aspect, the present disclosure relates to a multilayered label for use with a package. The label may be particularly advantageous for use with packages for medical devices, including both sterile and non-sterile medical devices. The multilayered label may be used on rigid or flexible substrates, including those commonly found in the field of medical devices. For instance, the label be applied and secured to a cardboard box or a low-density polyethylene foil, for example.

Figure 1:
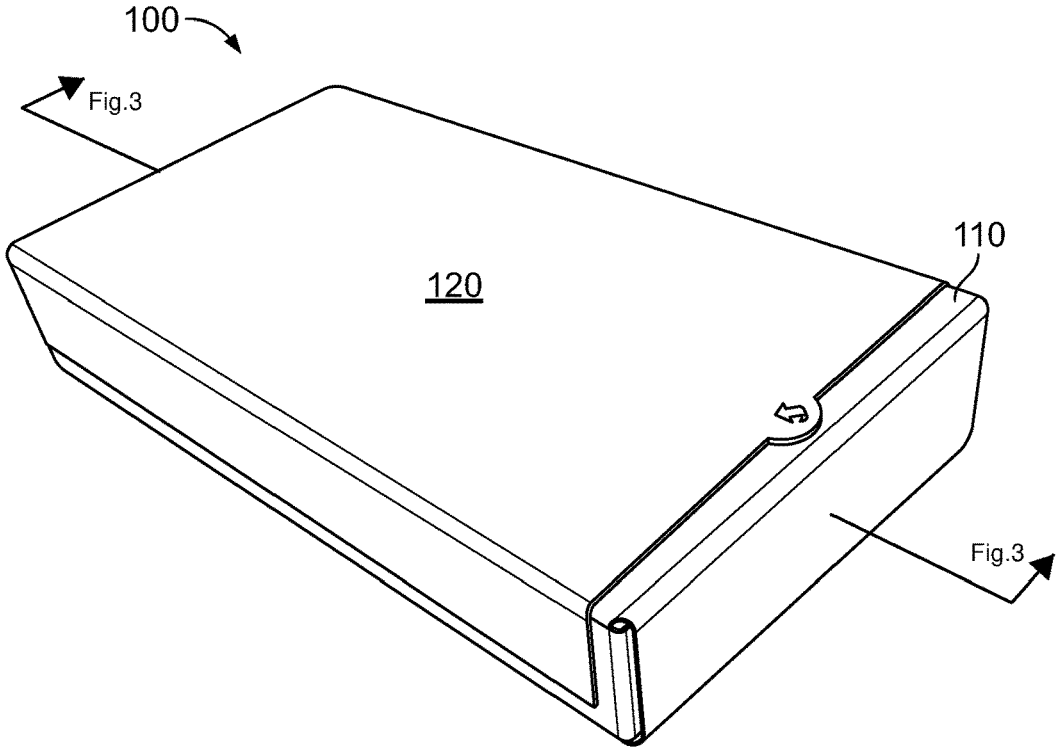
FIG. 1 is a perspective view of a labeled package according to one embodiment of the disclosure.
Figure 3:
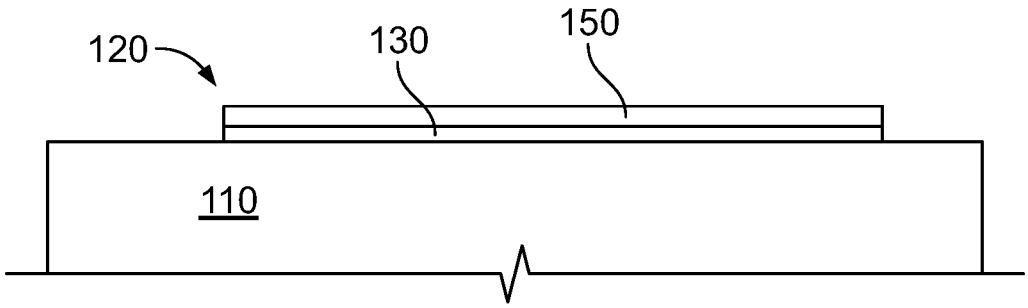
FIG. 3 is a cross sectional view of the labeled package of FIG. 1.

One embodiment of a label is shown as part of labeled package 100 in FIG. 1. Labeled package 100 includes label 120 and package 110. Label 120 is multilayered and includes a base layer 130 and a top layer 150, as shown in FIG. 3. Commonly known adhesive techniques may be used to adhere top layer 150 to base layer 130. Each layer of material has properties so that part or all of surfaces of the layers may be written or printed on, as described throughout the present disclosure. For example, one or both of the layers may be made of paper, a polymer or a combination of both.

Figure 4:
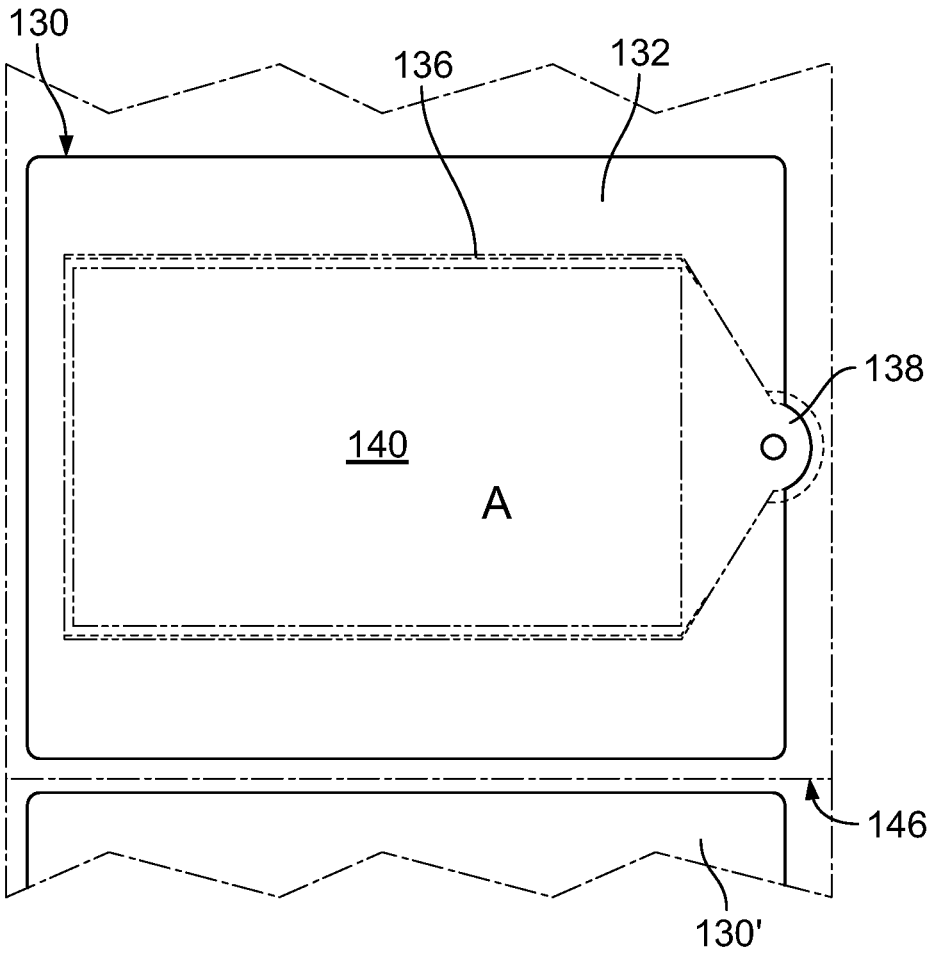
FIG. 4 is a plan view of a base layer of the label of FIG. 3.

Base layer 130, best shown in FIG. 4, includes a front surface 132 that faces top layer 150. A central surface 140 of the front surface has an area commensurate with an area within a perforated perimeter of top layer, described further below. Text and imagery may be applied to central surface 140 via permanent thermal transfer printing technology. The central surface may be coated with a silicon varnish. One advantage of such coating is that it significantly reduces the risk that the legibility of the text and/or imagery will deteriorate over the course of the expected use of the label. Central surface 140 has a tapering shape at one end and terminates at an apex in the form of flap base 138. This structure and its shape corresponds to the top layer to be secured over the base layer. On or adjacent to the surface of the flap base, glue may be disposed so that top layer 150 is adhered to base layer 130 at the flap, one of multiple securement features to prevent accidental opening of the top layer during expected handling of the package that accompanies the label.

Figure 5:
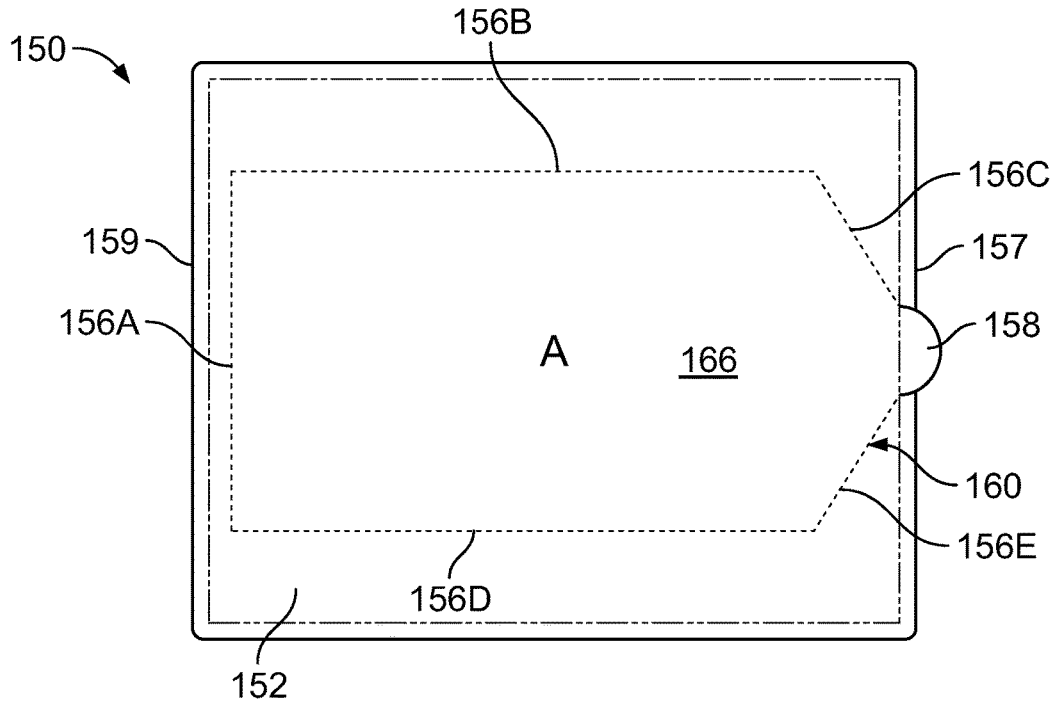
FIG. 5 is a plan view of a front side of a top layer of the label of FIG. 3.
Figure 6:
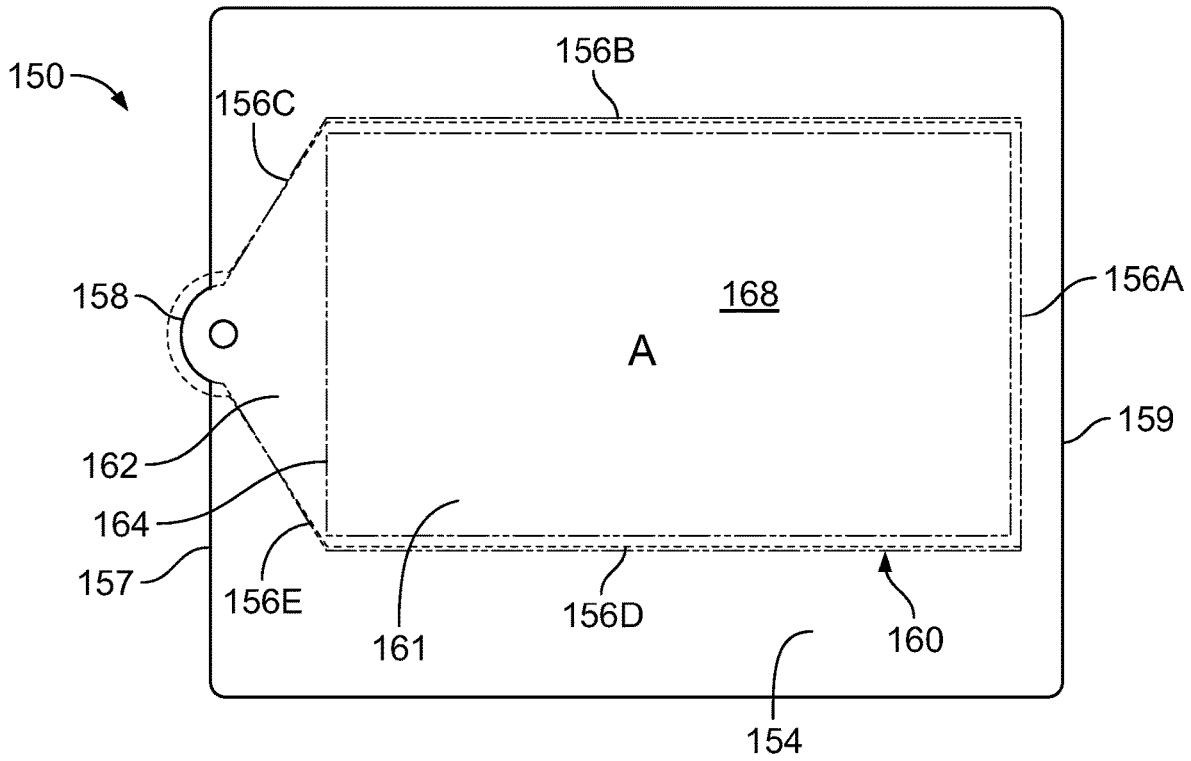
FIG. 6 is a plan view of a back side of the top layer of the label of FIG. 3.

Top layer 150 is best shown in FIGS. 5 and 6, where FIG. 5 shows an outward front surface of the top layer while FIG. 6 shows a back surface of the top layer. When label 120 is unopened, back surface 154 of top layer 150 faces front surface 132 of base layer 130. As with base layer 130, text and imagery may be applied to surfaces of top layer 150 via permanent thermal transfer printing technology. Top layer 150 as shown has an overall rectangular shape and includes perforations 156A-E internal to its outer perimeter. Such perforations may be created to have integrity that prevents unintentional opening due to forces such as mechanical stresses. Adjacent to trailing edge 159, perforations 156A, 156B, 156D define a rectangular area, with perforations 156B, 156D being generally parallel. Adjacent to leading edge 157, perforations 156C, 156E taper from ends of perforations 156B, 156D toward a flap 158. Perforations 156C, 156E extend to leading edge 157 of top layer 150 such that flap 158 separates perforations 156C, 156E. And, flap 158 extends outward and protrudes from leading edge 157. On the front surface of flap 158, an arrow or other indicator may be printed to indicate a direction to pull the flap in order to break the perforations, a process described in greater detail elsewhere in the disclosure. To ensure top layer 150 does not accidentally detach from base layer 150, flap 158 may be attached to flap base 138. Attachment may be with glue, as already noted, or another adhesive.

A portion of the top layer internal to the perforations and inclusive of flap 158 defines a detachable part 160. Detachable part 160 includes a front surface 166 and a back surface 168. Front surface 166 may be used to identify the product and the contents of the package accompanying the label and may be printed on as appropriate. In some examples, the front surface may also include any number of additional details about the product, such as dates related to manufacture of the product and its shelf life, along with information associated with the product supplier. In the above and other examples, the package identified by such a label may contain a medical device. Back surface 168 may be treated with a release varnish. Such treatment greatly reduces or eliminates any stickiness that would otherwise develop due to oxidization of back surface 168 once it is exposed to air upon removal of detachable part 160 from its position attached to base layer 130. Back surface 168 is treated such that it may receive markings from common writing tools, such as a ballpoint pen. Such writing may be done in a permanent manner. In some examples when the label is applied on a package for a medical device, markings on the back surface may include one or more of patient information such as a name and an address, applicable date(s), and service provider contact information for use by the patient, among other details. Additionally, in some embodiments, and as shown in FIG. 6, detachable part 160 may include an additional perforation 164 to remove an extended flap 162 and reduce detachable part 160 into a card 161 with a rectangular shape. Specifically, card 161 may be defined by perforations 156A, 156B, 156D, 164.

Turning to materials, the material of the top layer 150 is opaque such that when detachable part 160 covers base layer 130, nothing is visible beyond front surface 152 of top layer 150. In some examples, top layer 150 is entirely opaque. In other examples, only detachable part 160 is opaque.

A ratio of an overall length and overall width of the top layer may vary from that shown in the Figures. Similarly, dimensions of each layer may vary to suit particular applications. In some examples particularly well suited for medical device applications, top layer may have an overall length of approximately 100 mm and an overall width of approximately 80 mm. In some examples, card 161 may have a length of approximately 80 mm and a width of approximately 50 mm, a size similar to that of a credit card that may easily fit into a wallet. The base layer may be varied in a similar manner and/or in a manner appropriate for particular applications. As to the perforations, in some examples, the position of the perforations relative to the outer perimeter of the top layer may vary from that shown in FIGS. 5 and 6 and the angle of taper of the tapered perforations may also vary. An exact size and shape defined by the perforations may be guided by the amount of information desired to be conveyed through the label such that the perforations may be closer to the outer perimeter of the top layer where more information is to be conveyed, and so on.

One advantage of the multilayered label is that it provides a high ratio of content space, e.g., space for the inclusion of text and/or imagery, relative to an overall surface area of the label adhered to a package. In particular, label 120 provides three separate surfaces that can include written information: central surface 140 on base layer 130 and front and back surfaces 166, 168 of detachable part 160 on top layer 150. All of these are provided within an overall surface area of top layer, or even within a surface area of detachable part 160, yet provide a surface area for the inclusion of content that is at least three times that of a surface of detachable part 160. In this manner, smaller labels may be used than what would otherwise be required without the multilayer label, thereby providing increased efficiency for users of the label through the smaller spatial footprint.

The label may be varied in many ways. For example, in some embodiments, the top layer may include perforations along a length of the detachable part, but may have an adhesive to hold the detachable part to the base layer along the trailing edge. In some embodiments, a detachable part of a top layer may be separable from the label via a pair of perforation lines, each extending across a width of the label such that when the detachable part removed, a remaining top portion includes two separate parts adhered to the base layer at opposite ends of the label. In some embodiments, the top layer may have a fully enclosed perforated part, the enclosed perforation being entirely within an outer perimeter of the top layer and having an opening at one location along the perforation to remove the detachable part. In some embodiments, the detachable part of the top layer may include a fully enclosed perimeter of perforations entirely inside the perforations used to remove the detachable part from a remainder of the top layer. These perforations may be used to retrieve for later use a card smaller than the detachable part or a card smaller and having a different shape from the detachable part. It should also be appreciated that although certain embodiments of the present disclosure describe specific types of content for the markings applied onto the various surfaces of the top layer and the base layer, other content, including any combination of content, may be applied onto those surfaces as desired and appropriate under the circumstances. For example, in certain contexts, information other than product information may be included on the front surface of the top layer. Additionally, it should further be appreciated that although certain embodiments describe application of the label to a medical device package, the present disclosure is not so limited and may be employed with packages that contain other products.

In another aspect, the present disclosure relates to a method of fabricating an array of labels. In some embodiments, label 120 may be fabricated as an array of labels that may be separated into individual labels when ready to be applied to packaging. In one example, an array of labels may be fabricated in continuous linear structure and then rolled up to be stored as a roll of labels. In another example, an array of labels may be fabricated and then stored in a z-fold. In some examples, a perforation is created between each label in the label array to simplify separation when the labels are ready to use. One example of this is shown in FIG. 4, where perforation 146 separates base layer 130 from base layer 130'. In other examples, the labels are fabricated without perforations.

Figure 2:
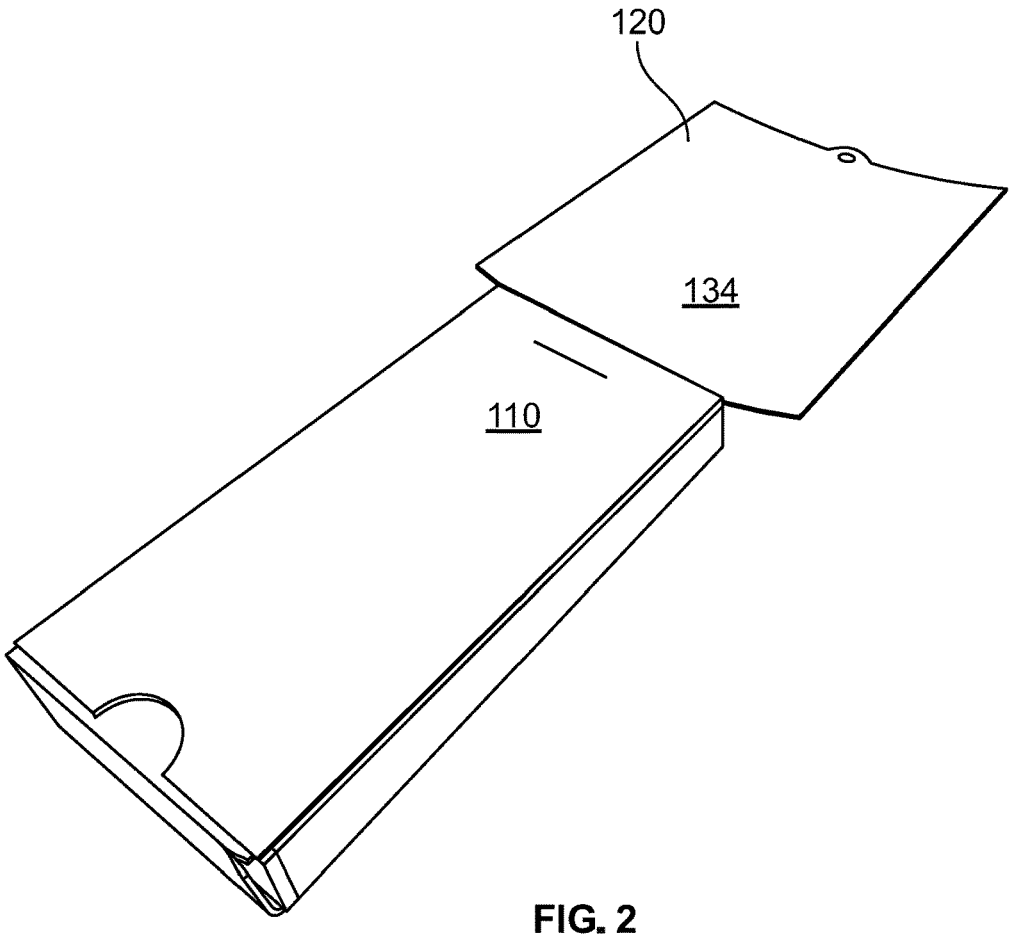
FIG. 2 is a perspective view of the package of FIG. 1 with the label detached from the package.

In another aspect, the present disclosure relates to a method of applying a label, with top layer adhered to base layer in a fully assembled condition, onto a package. In one embodiment, label 120 may be applied to a surface of a package, such as package 110, with the use of commonly known adhesives and other similar technologies. For instance, an adhesive may be applied to a bottom surface 134 of label 120 as shown in FIG. 2 to adhere label 120 to package 110. And, as shown in FIG. 2, the label may be folded at its periphery to accommodate placement on a narrower substrate, if necessary. In some examples, a label may fit entirely on one surface of a package. In other examples, a label may fold over edges so that the label is adhered to more than one surface of a package.

Figure 7:
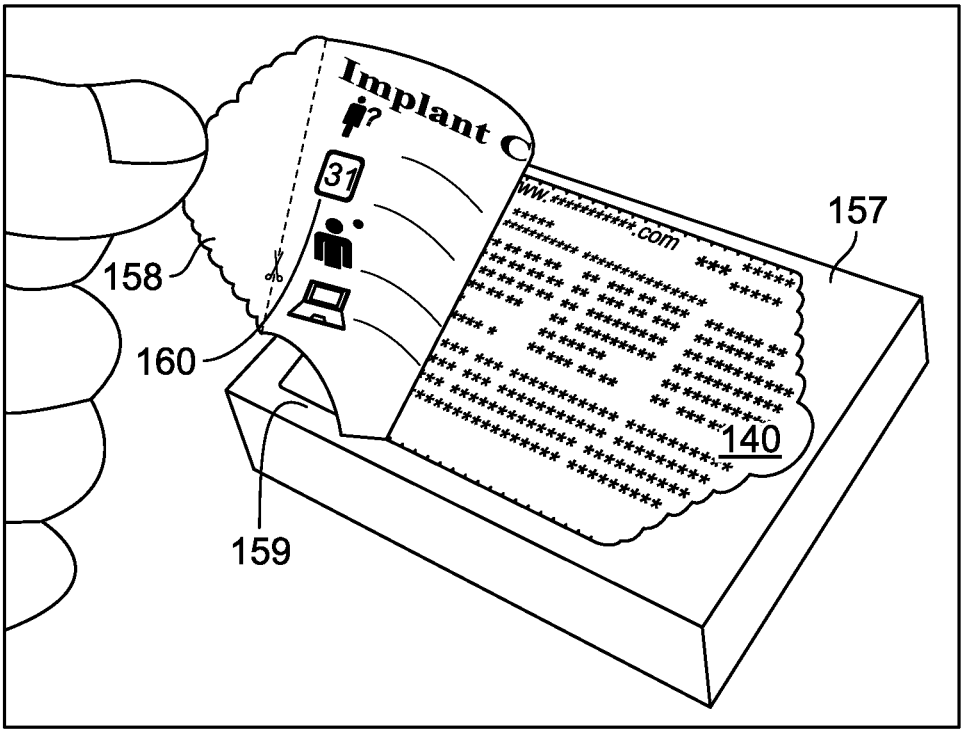
FIGS. 7-8 illustrate steps in a method of removing a top layer of a label from a bottom layer of a label according to one embodiment of the disclosure.
Figure 8:
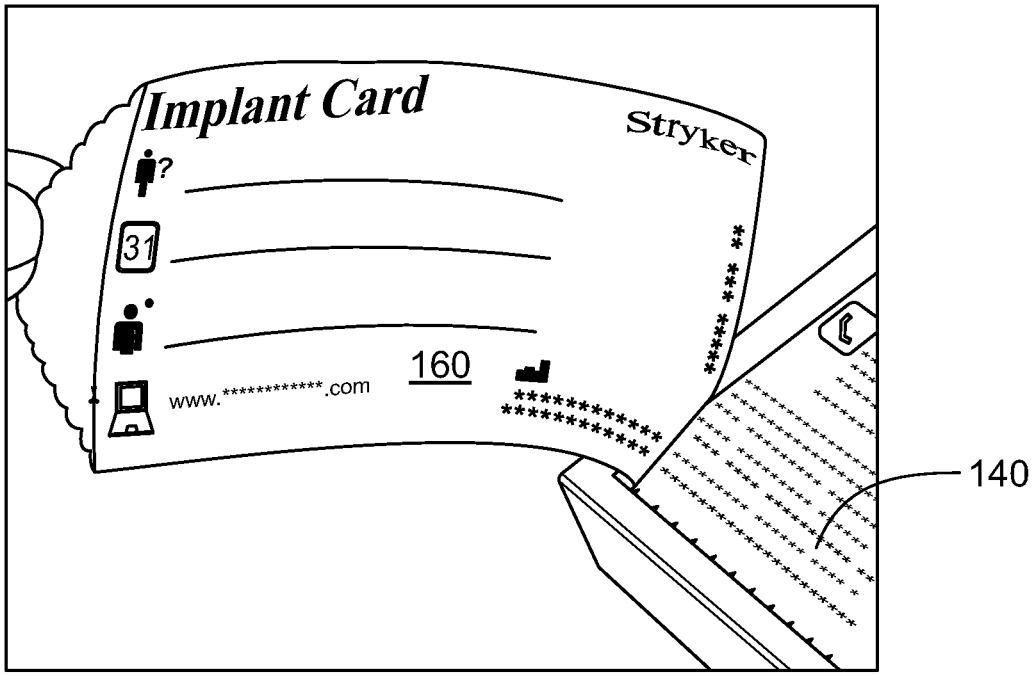
Figure 9:
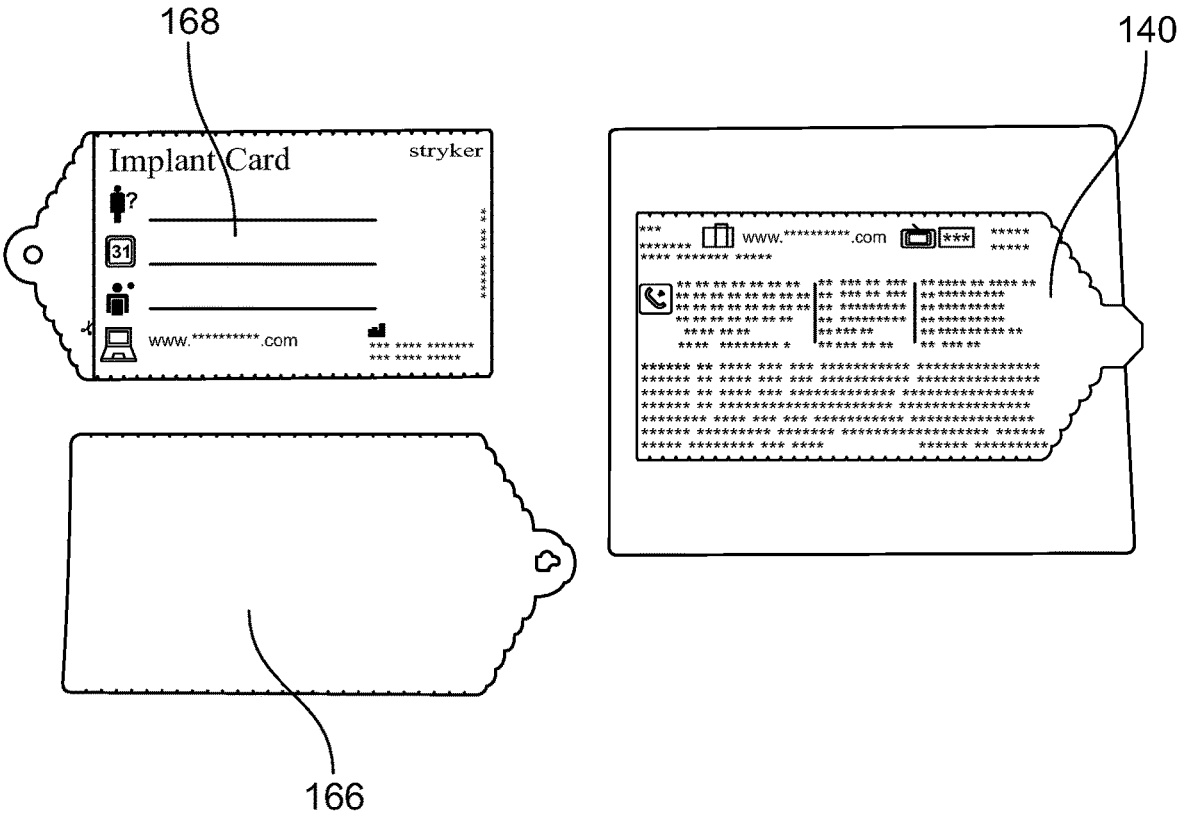
FIG. 9 is a top view of parts of the label of FIGS. 7-8 where the front of the detachable part, the back of the detachable part and the base layer are each shown separately.

In yet another aspect, the present disclosure relates to a method of using a multilayered label. In one embodiment, a method of opening the label on a package is contemplated. One example of such method is illustrated in FIGS. 7-9. To open the label, flap 158 is pulled from its initial position on leading edge 157 of top layer. Initially, the adhesive between flap 158 and flap base 138 is broken. Then, flap 158 is pulled from leading edge 157 toward the trailing edge 159. If this action is being performed while the label is oriented so that the text is facing right side up, the motion is from right to left, as shown in FIGS. 7-8. And, through this motion, the perforations in the top layer break to separate detachable part 160 from a remainder of top layer 150 until detachable part is completely removed from the remainder of the label, as shown in FIG. 9. The detachable part is then ready for use as a separate information card or for another purpose, and the previously hidden information on central surface 140 and back surface 168 is now visible.

Further advantages of the multilayered label include that some of the written materials may be kept confidential by including them on central surface 140 or on back surface 168, since top layer 150 is opaque. Additionally, even when the label is applied to a transparent package, markings on the central surface or on the back surface are not visible from either above the label or through the package via the underside of the label. Another security feature is that those confidential contents are tamper proof with the contemplated label. Because the information on central surface 140 and back surface 168 may only be viewed once perforations 156A-E are broken, the recipient of the package with the label will recognize whether the label has been tampered with and thus will know whether someone may have viewed the text, imagery or other content on central surface 140 or back surface 168. Yet another advantage of the label is that the detachable part may easily be removed in its entirety to function as a card to convey information about the contents of the labeled package for the records of a receiving hospital, for a patient, or for another interested party. In one example, back surface 168 of detachable part 160, 161 may be used as an "Implant Card" to be filled out by a physician or hospital to satisfy European Union Medical Device Regulations. In some examples, the content of the back surface of the detachable part may include information such as that outlined above respecting back surface 168. The detachable part, e.g., information card, allows a recipient of a package to obtain information about the package in a separate document without having to open the package to retrieve such information, thereby saving time and avoiding unnecessary handling of the package contents.

Although the disclosure herein has been described with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the spirit and scope of the present disclosure as defined by the appended claims.

The invention claimed is:

1. A label attachable to a package, the label comprising:

a base layer including a first surface adapted to receive written markings and a second surface opposite the first surface, the second surface positionable onto a package; and a top layer attached to the base layer such that the top layer covers the first surface, the top layer comprising:

a peripheral part; and a detachable part within the peripheral part, a first portion of a perimeter of the detachable part having perforations separating the detachable part from the peripheral part and a second portion of the detachable part forming a free end of the detachable part, wherein the detachable part is removable from the peripheral part of the top layer by pulling the free end away from a first end of the top layer toward a second end of the top layer opposite the first end, the detachable part being fully removable from the peripheral part, and wherein the detachable part has a front surface and a back surface opposite the front surface, both surfaces being adapted to receive written markings, wherein the perimeter of the detachable part forms a closed loop within the peripheral part, the detachable part having a tab at the free end unconnected to the peripheral part, wherein the perforations extend along a first side of the detachable part from the free end to a second end of the detachable part opposite the free end and along a second side of the outer edge opposite the first side from the free end to the second end, and wherein the detachable part includes a trailing side at the second end, the trailing side extending between the first side and the second side and being unconnected to the peripheral part.

2. The label of claim 1, wherein the detachable part has a first surface area and the top layer has a second surface area, the first surface area being at least 50% of the second surface area.

3. A system comprising:

a package; and the label of claim 2, the label having a surface area in contact with the package that is equal to the second surface area.

4. The label of claim 1, wherein the back surface of the detachable part has a first surface area and the label has a total surface area adapted to receive written markings that is at least three times the first surface area.

5. The label of claim 1, wherein written markings include at least one of printed text and printed imagery created through a thermal transfer process.

6. A label for a package comprising:

a base layer adherable onto a package, the base layer including a central surface adapted to receive written markings; and a top layer attached to the base layer such that the top layer covers at least part of the base layer, the top layer including perforations such that a detachable part is at least partially defined by the perforations, the detachable part having a first portion bound by an inner periphery with the perforations and a second portion forming a free end of the detachable part, the inner periphery of the first portion comprising:

a first lateral edge;

a second lateral edge; and a trailing edge connecting the first and second lateral edges, wherein each of the first and second lateral edges extends from the free end;

wherein the detachable part has a front surface; and a back surface opposite the front surface, the back surface facing the central surface while the perforations remain intact, wherein the first lateral edge includes a first leading portion that flares outward from the second portion toward the trailing edge and the second lateral edge includes a second leading portion that flares outward from the second portion toward the trailing edge such that a dimension between the first and second edges becomes larger moving away from the second portion toward the trailing edge, wherein the front and back surfaces of the top layer are adapted to receive written markings, and wherein the top layer is opaque such that while the perforations remain intact, any written markings on the back surface of the detachable part or on the central surface of the base layer are not visible from a vantage point outside of the label.

7. The label of claim 6, wherein a majority of the perimeter inner periphery of the detachable part is surrounded by a stationary part of the top layer.

8. The label of claim 7, wherein the detachable part includes a tab at the free end.

9. The label of claim 6, wherein the perforations include a first segment across a width of the top layer and a second segment across the width of the top layer, the first segment being separate from the second segment such that the top layer includes first and second stationary parts on opposite sides of the detachable part.

10. The label of claim 9, wherein the detachable part further comprises a tab, the tab being located at the free end.

11. The label of claim 6, wherein written markings include at least one of printed text and printed imagery created through a thermal transfer process.

12. A label attachable to a package comprising:

a base layer including a front surface adapted to receive written markings thereon; and a top layer attached to the base layer, the top layer including a detachable portion, a peripheral portion and an interface structure between the detachable portion and the peripheral portion, the detachable portion including a front surface and a back surface, the back surface facing the front surface of the base layer and adapted to receive written markings thereon, wherein the top layer is configured such that pulling of the detachable portion relative to the peripheral portion causes the interface structure to tear, separating the top layer from the base layer such that the interface structure is permanently severed, and wherein the detachable portion includes a sub-portion that is removable from the detachable portion, the sub-portion being defined by an inner interface structure on the detachable portion.

13. The label of claim 12, wherein the interface structure is a plurality of perforations.

14. The label of claim 12, wherein the top layer is made of a material such that any written markings on the back surface of the top layer are not observable from a vantage point outside of the label when the interface structure is intact.

15. The label of claim 12, wherein the detachable portion of the top layer has a perimeter and a majority of the perimeter is surrounded by the peripheral portion.

16. The label of claim 15, wherein at least some of the perimeter of the detachable portion is not defined by the interface structure.

17. The label of claim 12, wherein the peripheral portion includes a first subpart and a second subpart spaced apart from the first subpart, the detachable portion being in between the first subpart and the second subpart.

18. The label of claim 12, wherein the inner interface structure is entirely spaced apart from the interface structure.

* * * * *